US007997852B1

(12) United States Patent
Campbell et al.

(10) Patent No.: US 7,997,852 B1
(45) Date of Patent: Aug. 16, 2011

(54) SIDE LOADER GARBAGE TRUCK

(75) Inventors: Paul Campbell, Chandler, AZ (US); Wendell Perkins, Tempe, AZ (US); Ron Alderfer, Phoenix, AZ (US)

(73) Assignee: Arizona Refuse Sales, Phoenix, AZ (US)

( * ) Notice: Subject to any disclaimer, the term of this patent is extended or adjusted under 35 U.S.C. 154(b) by 496 days.

(21) Appl. No.: 12/214,090

(22) Filed: Jun. 16, 2008

Related U.S. Application Data

(60) Provisional application No. 60/936,484, filed on Jun. 19, 2007.

(51) Int. Cl.
*B65F 3/02* (2006.01)

(52) U.S. Cl. ..... 414/812

(58) Field of Classification Search ..... 414/525.5, 414/718, 487, 525.55, 812; 212/177, 299
See application file for complete search history.

(56) References Cited

U.S. PATENT DOCUMENTS

| | | | | | |
|---|---|---|---|---|---|
| 3,232,463 | A * | 2/1966 | Weir | 414/493 |
| 4,096,959 | A * | 6/1978 | Schaffler | 414/408 |
| 4,260,316 | A * | 4/1981 | Gollnick | 414/501 |
| 4,428,407 | A * | 1/1984 | Bourbeau | 144/24.13 |
| 4,464,092 | A * | 8/1984 | Chambers et al. | 414/534 |
| 4,473,333 | A * | 9/1984 | Stuart | 414/493 |
| 5,029,522 | A * | 7/1991 | Brisson | 100/233 |
| 5,341,962 | A * | 8/1994 | Way et al. | 222/248 |
| 5,704,086 | A * | 1/1998 | Hansen et al. | 14/71.5 |
| 6,719,226 | B2 * | 4/2004 | Rajewski | 241/30 |
| 6,854,949 | B2 * | 2/2005 | Huang | 414/525.2 |
| 2005/0135910 | A1 * | 6/2005 | Pruteanu et al. | 414/517 |

* cited by examiner

*Primary Examiner* — Charles A Fox
(74) *Attorney, Agent, or Firm* — Sandy Lipkin

(57) ABSTRACT

An improved side loading garbage truck that includes an improved packing method that utilizes a packing blade that doubles as the hopper cover, that includes its hydraulic cylinders outside the body of the truck, does not have any potential leak points inside the body and includes all grease points outside the body providing easier access to the cylinders, blade and grease points for maintenance and installation. The other improvement is the use of multi-point contact rollers thereby reducing wear and tear and extending the life of the side loader arm.

1 Claim, 5 Drawing Sheets

SIDE LOADER GARBAGE TRUCK

REFERENCE TO PRIOR APPLICATION

This application claims the priority of provisional application 60/936,484, filed Jun. 19, 2007 entitled SIDE LOADER GARBAGE TRUCK by Paul Campbell (previously misspelled "Cambell", Wendell Perkins and Ron Alderfer.

BACKGROUND OF THE INVENTION

1. Field of the Invention

The present invention relates generally to the field of garbage trucks and particularly to an improved garbage truck that utilizes a unique, high-efficient packing method and multi-point contact rollers.

2. Description of the Prior Art

Garbage trucks, as we all know, are needed in order to control waste and remove it to a location not proximate to where people live and work. To serve this purpose, many designs of trucks have been put into use that are highly specialized and automated in an effort to increase efficiency and to cope with an ever-increasing amount of garbage, at the lowest cost.

There are five common kinds of garbage trucks. These include the front loader, the rear loader, the side loader, recycling trucks and roll-off trucks. Each is used for a different type of garbage collection. The instant invention deals, with an improved type of side loader.

A side loader has an opening for the trash that is located on the side of the truck, just behind the cab, where the driver or loader can reach it quickly. With a manual side loader, the trash is manually dumped into the opening. With an automated side loader, a hydraulic arm with a gripping member on the end grabs the trash container and quickly dumps the contents into the opening. Side loaders are used to pick up trash in residential areas.

The loader arm of a side loader garbage truck is located between the body/hopper and the backside of the chassis cab. The purpose of this type of truck is to allow for a one man operation for pickup up 60 to 300 gallon refuse containers located in residential areas. These trucks pick up garbage from approximately 600 to 1500 homes each day.

Garbage trucks have a variety of sub-assemblies that aid in the collection and removal of garbage. These include the lift arms, grabber assemblies, hopper cover, tailgate and packer blade. The instant invention offers improvements to the packing method utilizing an improved packer blade and to the contact roller that is a part of the lift arm.

One prior art packing method is described in U.S. Pat. No. 5,513,942 which is manufactured by Heil. The Heil side loader provides for a 180 degree sweep packer paddle. This provides for a side to side horizontal sweeping motion of the paddle. There is a hole in the floor of the truck that houses the paddle bearing, providing for a potential leak point at the floor seal. The cylinders that move the blade are mounted under the body, which provides a difficulty in gaining access for maintenance. Additionally, the grease points are also located under the body providing the same difficulty in gaining access for maintenance.

Another prior art packing method is the push pack design. This method provides for a horizontal push pack blade that moves from the front to the rear of the truck in a horizontal motion. This method requires a follower panel for the continuous dump of garbage. One downside to this method is the fact that garbage can accumulate behind the blade during operation. A manual cleanout trap is required to overcome this problem. Like the Heil product described above, this method provides for the cylinders to be mounted inside the body and carries the same drawbacks to access for maintenance. The cylinders are susceptible to damage from garbage. Again, the grease points are inside the body, creating difficulty to access for maintenance. Accordingly, servicing of the blade and associated components must be accomplished from inside the body.

Yet another prior art packing method is the rear loader design wherein the cylinders are still found inside the body, providing for difficulty in access for maintenance. The cylinders are susceptible to damage from garbage. The packing blade of this method installation and removal requires one person inside the body. Servicing of the blade and associated components must be done from inside the body.

It is one object of the instant invention to provide a packing method that overcomes the shortcomings of the prior art.

The instant invention provides for a sealed hopper floor that has no openings in the floor thereby eliminating the potential for leakage.

The instant invention provides that the cylinders be located above the chassis rails and outside the body for improved ease of maintenance.

The instant invention has grease points located outside of the body providing for improved ease of maintenance.

In the instant invention, the blade doubles as a hopper cover during the transport of trash.

In the instant invention, the servicing of the blade and associated components are done from outside of the body.

In the instant invention, blade removal and insertion is accomplished from outside the body.

Another improvement in the instant invention is the refuse loader arm. Prior art refuse loader arms have single point contact rollers. The rollers are used during the operation of the loader to reduce wear between the fixed part of the loader arm and the part of the loader arm that extends to pick the trash container. The instant invention seeks to improve on this aspect of the garbage truck by providing a multi-point contact tandem axle roller carriage assembly.

The loader arm of the instant invention utilizes multiple rollers providing for improved load distribution and reduction in the wear on the arm. The tandem axle has a center pivot pin that allows for multi-point contact between the rollers and the wear strip and that provides for reduced binding on the arm during arm extension. Removal of the carriage allows for the easily removal of multiple rollers.

SUMMARY OF THE INVENTION

The preferred embodiment of the present invention teaches an improved packing method for a side-loader garbage truck wherein the side-loader garbage truck includes a chassis cab, an automated side loader arm located proximate to the chassis cab wherein the side loader arm moves in a multi-directional fashion to accomplish the task of grasping a garbage container, lifting the garbage container above the truck and tilting the garbage container to empty the contents of the garbage container, an opening for the placement therein of garbage from the garbage container, a packing blade operated through hydraulic cylinders for packing the garbage and a storage area located on the opposite end of the garbage truck from the chassis cab for the storage of the packed garbage, the packing method comprising the placement of garbage into the opening in the garbage truck for packing therein through the utilization of the side loader arm; the positioning of the packing blade in a first position so that the blade is proximate to the chassis cab, the blade is substantially parallel to the ground and the blade acts as a cover to the garbage, the packing blade being actuated with hydraulic cylinders that are located above the chassis of the garbage truck; the positioning of the packing blade in a second position so that the blade moves from the first position substantially parallel to the ground into a position substantially perpendicular to the ground so that the garbage is moved to a position distal to the chassis cab; the movement of the packing blade into a position proximate to the storage area and distal to the chassis cab thereby packing the garbage and moving the garbage into the storage area; and the positioning of the blade into a substantially parallel position relative to the ground while remaining proximate to the storage area and distal to the chassis cab thereby revealing the opening for the placement therein of garbage.

A second embodiment of the instant invention discloses an improved roller for a side loader arm for a side loading garbage truck wherein the roller is used to reduce wear between the fixed parts of the loader arm and the part of the loader arm that extends to pick up a trash container, the improved roller comprising a tandem axle with a center pivot pin; at least two rollers, each of the two rollers attached to the tandem axle thereby allowing multi-point contact between the rollers and contact points on the side-loader arm.

DETAILED DESCRIPTION OF A PREFERRED EMBODIMENT

Figure 1:
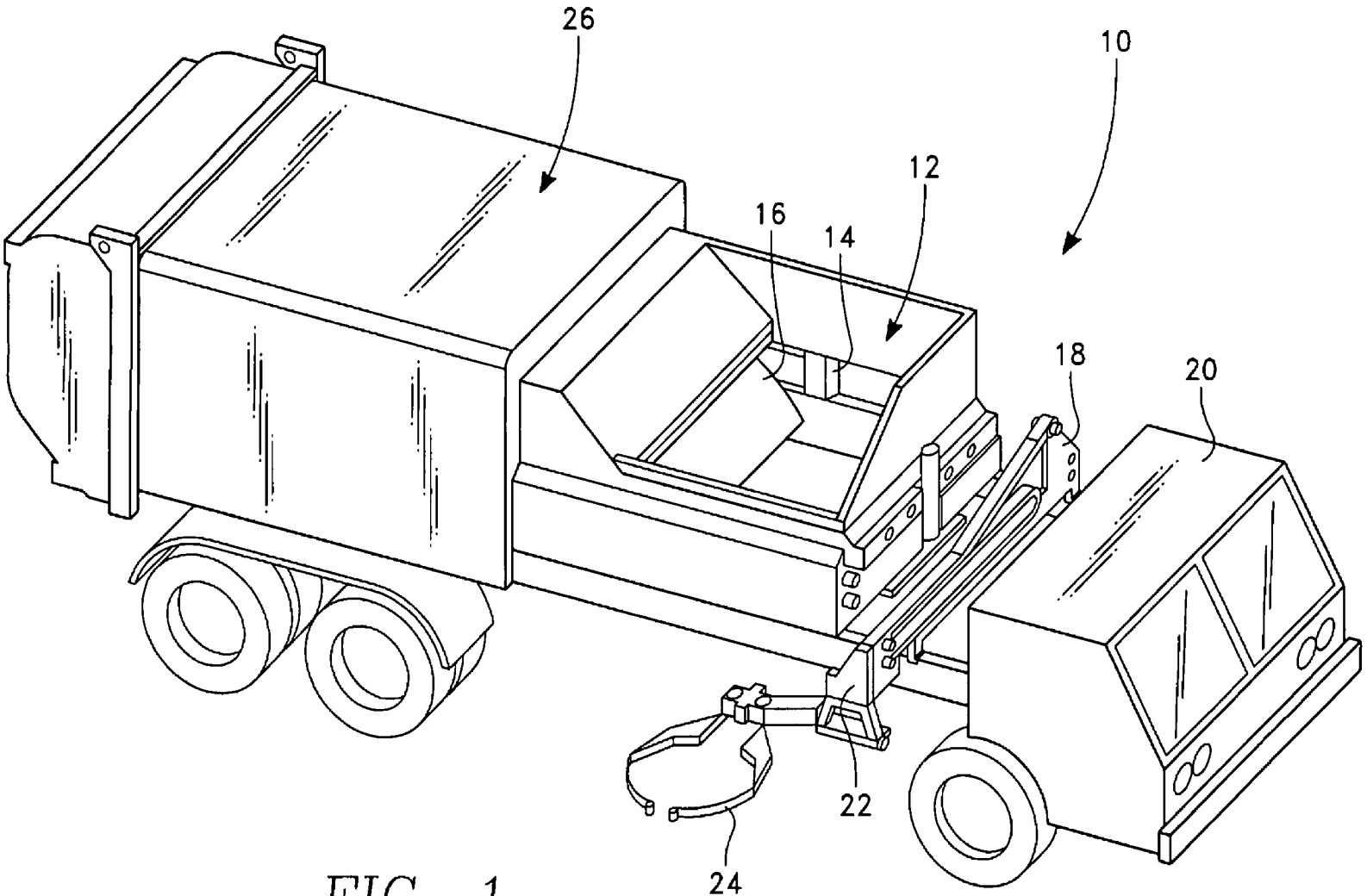
FIG. 1 is a perspective view of the entire garbage truck of the instant invention.
Figure 2:
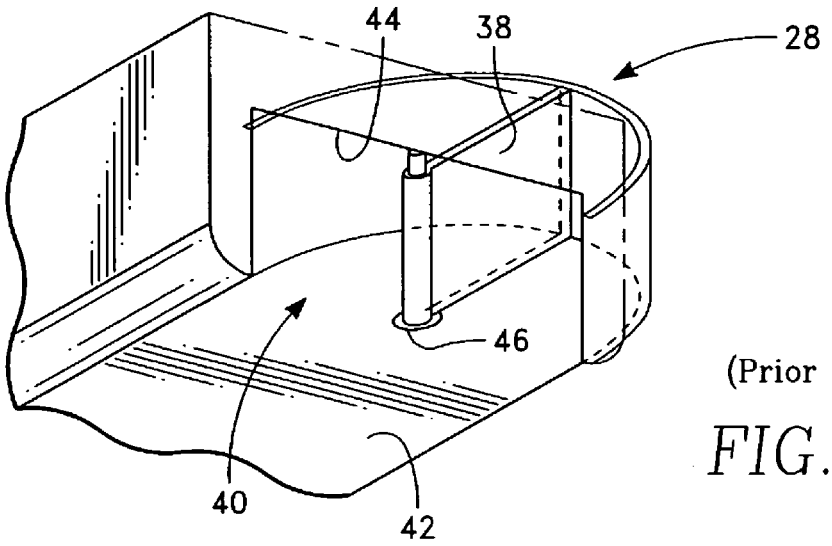
(Prior Art) FIG. 2
FIG. 2 is a view inside the prior art garbage truck that utilizes the 180 degree sweep packer paddle method.

Turning to the drawings, the preferred embodiment is illustrated and described by reference characters that denote similar elements throughout the several views of the instant invention.

The preferred embodiment refers to an improved side loader garbage truck 10, seen in total perspective view in FIG. 1. The major components of the truck 10 include the hopper opening 12, the slider 14, the packing blade 16, the automated loader arm 18, and the chassis cab 20. In operation, the automated loader arm 18 extends beyond the main body of the truck 10 using the multi-point quad roller assembly 22 (seen in detail in FIG. 10 and that is not visible in the view of FIG. 1).

The operator of the truck (not shown) sits in the chassis cab 20 and operates the loader arm 18 from within. The loader arm 18 includes a gripping mechanism 24 that grips a roadside trash can (not shown) of the sort typically seen in residential areas. The loader arm 18 then lifts in a vertical direction and tilts in a way to allow the contents of the garbage can to empty into the hopper opening 12. The slider 14 moves the entire assembly of the packing blade 16 in a horizontal direction starting in a position proximate to the chassis cab 20 and ending in a position distal from the chassis cab 20. The garbage is compacted and moved into the storage area 26 of the truck 10.

The position of the packing blade 16 of the instant invention is superior to prior methods that are illustrated in FIGS. 2-5. Prior art system #1 28 that is the subject of U.S. Pat. No. 5,513,942 shows the packing blade 38 that sweeps in a horizontal direction inside the body of the truck 40. The blade 38 is oriented in a vertical position and is attached to the floor 42 of the truck body and the ceiling 44 of the truck body. The blade 38 provides a 180 degree sweep, but includes holes in the floor 42 where the blade 38 is attached, providing a potential leak point at the floor seal 46. Cylinders (not shown) that operate the blade 38 are mounted under the body 40 along with grease points that provide difficult access for maintenance.

Figure 3:
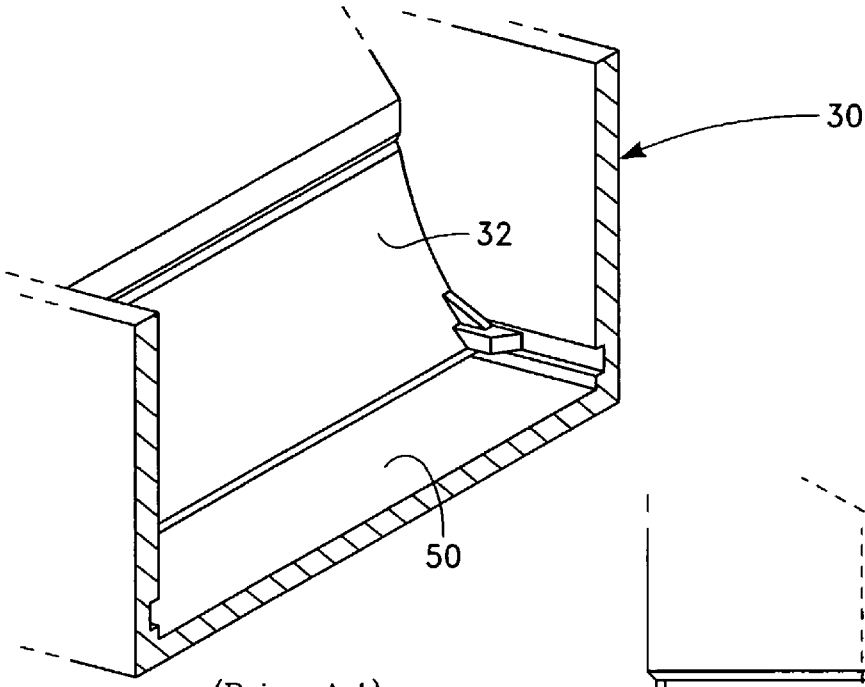
(Prior Art) FIG. 3
FIG. 3 is a view inside the prior art garbage truck that utilizes the push pack design.
Figure 4:
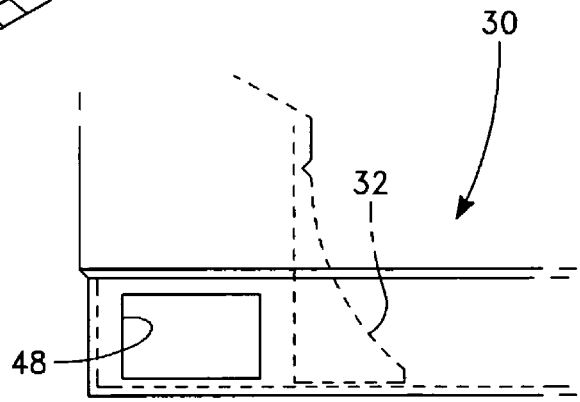
(Prior Art) FIG. 4
FIG. 4 is a view of the clean out trap required in the prior art push pack method.

Prior art method #2 is shown in FIGS. 3-4. In this sort of operation, the packing blade 32 moves in a front to rear horizontal motion and requires a follower panel (not shown) for the continuous dump of trash. In this type of system, trash can get behind the blade 32 during operation and requires the use of a manual cleanout trap 48 as shown in FIG. 4. In this system, the cylinders (not shown) are mounted inside the body 50, providing difficult access for maintenance and leaving the cylinders susceptible to damage from the trash. The grease points are located inside the body 50. Servicing of the blade 32 and associated components must be accomplished from inside the body 50 of the truck.

Figure 5:
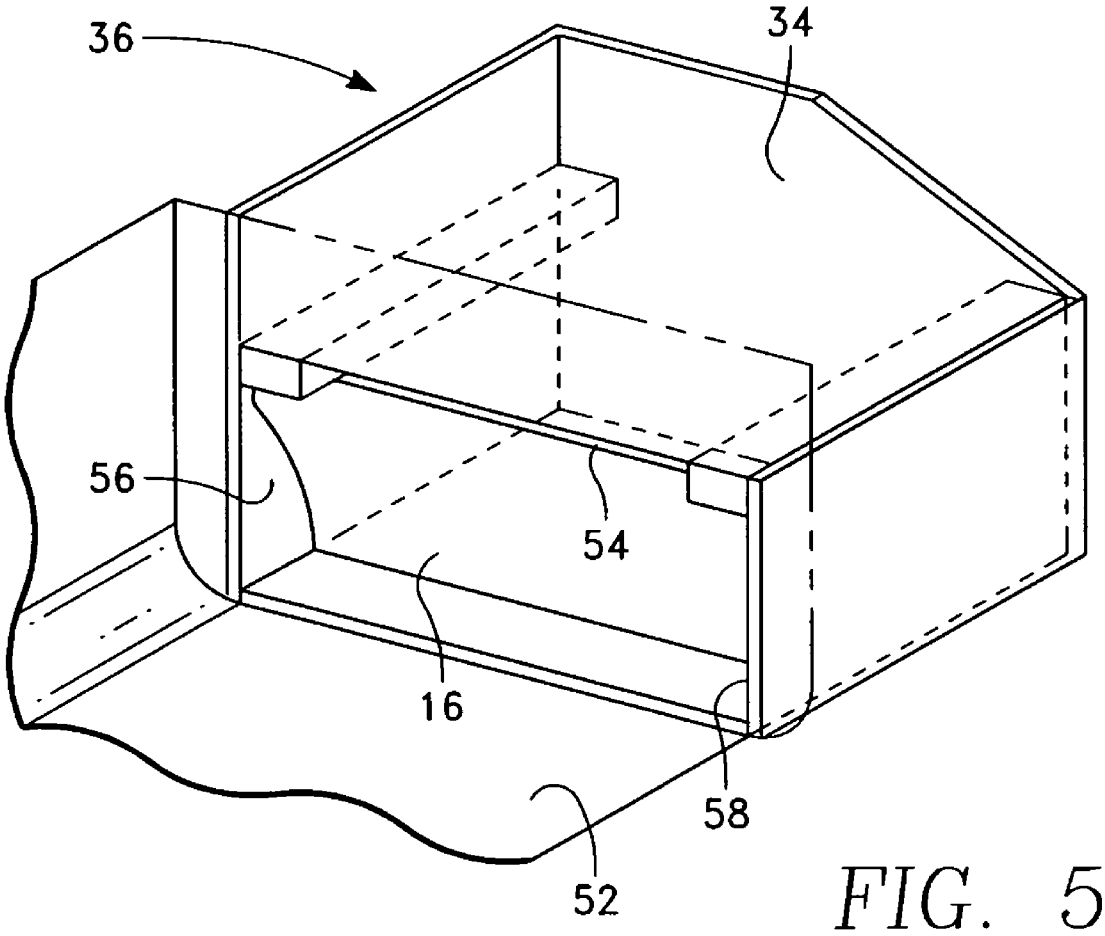
FIG. 5 is a view of the packer blade of the instant invention from inside the body of the garbage truck.

In contrast, FIG. 5 shows the packing method 36 of the instant invention. In this view, it can be seen that the blade 16 moves in a horizontal direction from the rear of truck 34 toward the front 52. The blade 16 is attached to the interior top portion 54 of the interior of the truck. The blade 16 extends from front 56 of the truck to the rear 58.

Figure 6A:
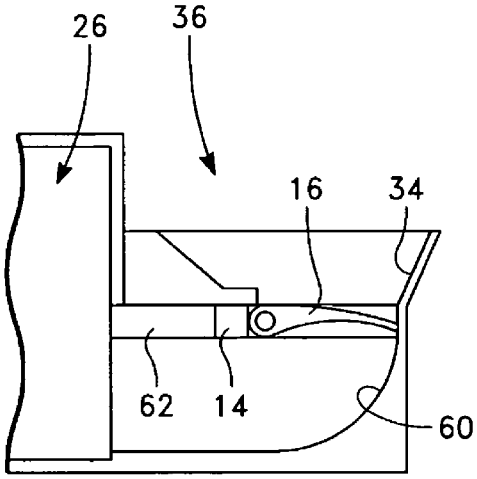
FIGS. 6A-D is a sequential view of the packing method of instant invention with FIG. 6A showing the packer in phase 1, which is the home position and FIG. 6B showing the packer in phase 2, which is the sweep down position and FIG. 6C showing the packer in phase 3, which is the full pack position and FIG. 6D showing the packer in phase 4, which is the sweep up position.

The entire cycle of the use of the blade system 36 is shown in FIGS. 6A-D. FIG. 6A demonstrates the blade 16 in the home position. In this home position, the blade is in a horizontal position is positioned parallel to the ground and can double as a hopper cover. In this position, trash is already placed in the hopper area 60 of the truck. The blade 16 is located in a channel 62 that allows the blade 16 to move in a horizontal position with the use of the slider 14. Once garbage is placed in the hopper area 60 of the truck, the blade 16 is moved to the home position parallel to the ground and in a position proximate to the chassis cab 20 of the truck and distal from the storage area 26 of the truck.

Figure 6B:
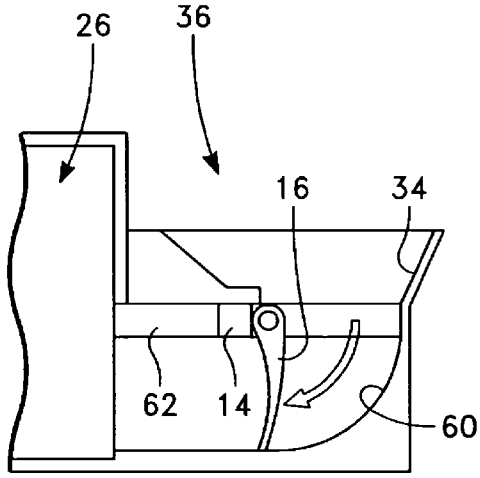

In FIG. 6B, it can be seen that in the second phase or swept down phase of operation, the blade 16 swings into a position perpendicular to the ground. Accordingly, any garbage in the hopper area 60 of the truck is moved toward the storage area 26 of the truck.

Figure 6C:
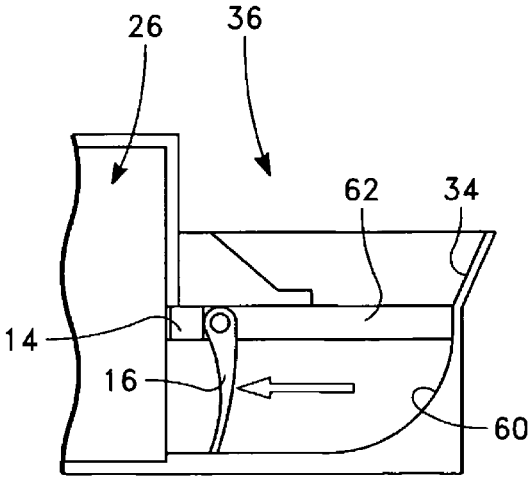

In FIG. 6C, the full pack position is shown. The blade 16 and slider 14 have moved the packing system through the channel 62 and toward the storage area 26 of the truck. The garbage has now been moved further toward the storage area and the garbage further packed. All movements are accomplished through the use of hydraulic cylinders which are not shown.

Figure 6D:
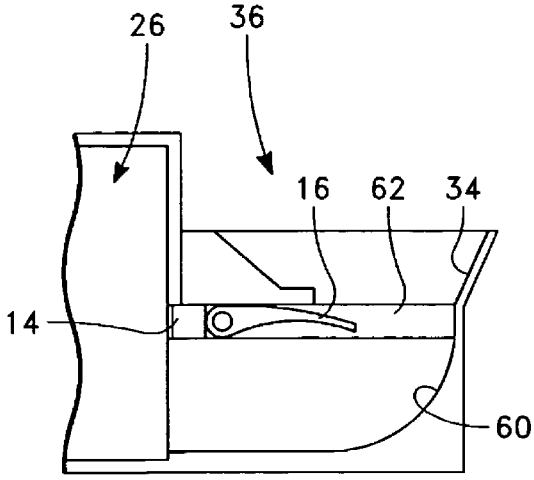

Finally, as seen in FIG. 6D, the blade 16 is moved to the swept up position which places the blade 16 in the same parallel to the ground position as seen in the home position in 6A, but with the blade 16 and slider 14 moved along the channel 62 to a position furthest distal from the chassis cab 20 and closest proximate to the storage area 26 of the truck. At this point, the hopper area 60 is completely exposed and ready to be refilled with garbage, using the side loader-arm, an improvement on which is described below.

Figure 7:
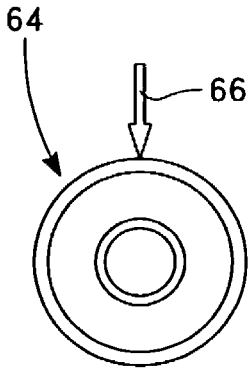
(Prior Art) FIG. 7
FIG. 7 is a prior art illustration of the single point contact rollers for the refuse loader arm.
Figure 8:
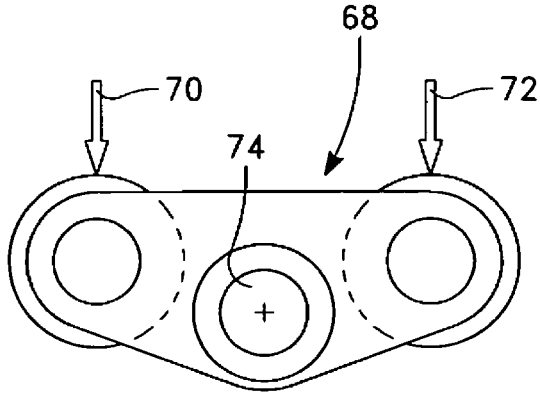
FIG. 8 is a side view of the multi-point contact rollers of the instant invention.

The improvement on the side loader arm includes the use of multi-point load contact points during operation of the side loader arm. Rollers are used during the operation of the loader arm to reduce wear between the fixed part of the loader arm and the part of the loader arm that extends to pick up the trash container. Rollers used to operate the side loader arm have in the past used a single loading point as seen in FIG. 7. The prior art roller 64 has but a single loading point 66. The improvement in the instant invention is shown in FIG. 8. The improvement 68 is a double point loading system that equalizes the load distribution. This system includes a first roller 70, a second roller 72 and a pivot point 74.

Figure 9:
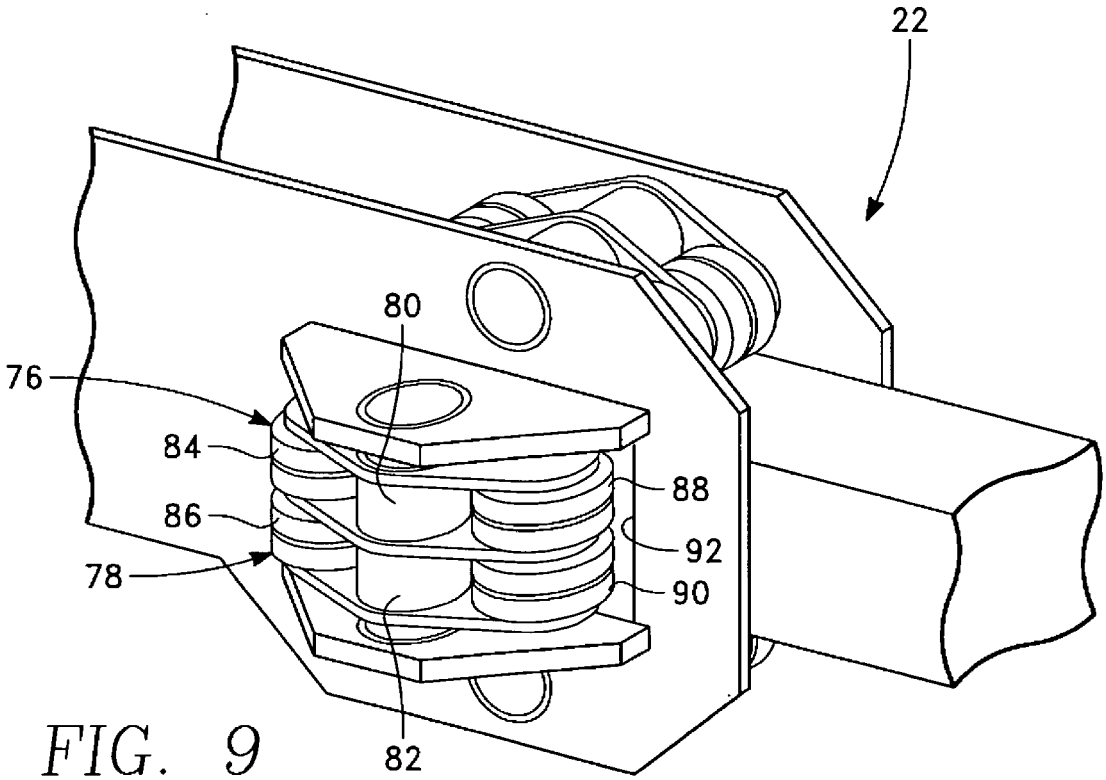
FIG. 9 is a perspective view of the dual quad roller assembly in the preferred embodiment of the instant invention.

FIG. 9 shows a dual quad roller assembly 22. The angle shown in FIG. 9 shows two rollers 76, 78 stacked one on top of the other. Each roller includes the pivot point 80, 82 and rollers 84, 86, 88, 90. The roller assembly 22 has a hole 92 through which the side loader arm is positioned.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An improved packing method for a side-loader garbage truck wherein said side-loader garbage truck includes a chassis cab, an automated side loader arm located proximate said chassis cab wherein said side loader arm moves in a multi-directional fashion to accomplish the task of grasping a garbage container, lifting said garbage container above said truck and tilting said garbage container to empty the contents of said garbage container, an opening for the placement therein of garbage from said garbage container, a packing blade operated through hydraulic cylinders for packing said garbage and a storage area located on the opposite end of said garbage truck from said chassis cab for the storage of said packed garbage, said packing method comprising placement of garbage into said opening in said garbage truck for packing therein through the utilization of said side loader arm while said packing blade sits in a channel substantially parallel to the ground so that said packing blade when in said substantially parallel position is movable in a horizontal direction to positions both distal and parallel said chassis cab and wherein said packing blade is located in said channel in a position distal said chassis cab thereby creating an opening for the placement therein of garbage;

positioning of the packing blade in a position so that said blade is proximate said chassis cab through the movement of said packing blade in said channel into a position wherein said blade is substantially parallel to the ground and wherein said blade acts as a cover to said garbage as it is in a position proximate said chassis cab and consequently over said opening, said packing blade being actuated with hydraulic cylinders that are located above said chassis of said garbage truck;

positioning of said packing blade in a second position so that said blade moves from said position substantially parallel to the ground into a position substantially perpendicular to the ground so that said garbage is moved to a position distal said chassis cab;

movement of said packing blade through said channel into a position proximate said storage area and distal said chassis cab thereby packing said garbage and moving said garbage into said storage area; and positioning of said blade into a substantially parallel position relative to the ground while remaining proximate said storage area and distal said chassis cab thereby revealing said opening for the further placement therein of garbage.

* * * * *